US007168340B1

(12) United States Patent
Green

(10) Patent No.: US 7,168,340 B1
(45) Date of Patent: Jan. 30, 2007

(54) RATCHET WRENCH HAVING CONSTANT DRIVE

(76) Inventor: Thomas S. Green, 3675 Laubert Rd., Atwater, OH (US) 44201

( * ) Notice: Subject to any disclaimer, the term of this patent is extended or adjusted under 35 U.S.C. 154(b) by 0 days.

(21) Appl. No.: 11/318,945

(22) Filed: Dec. 27, 2005

(51) Int. Cl.
*B25B 17/00* (2006.01)

(52) U.S. Cl. ..... 81/57.3; 81/57.31

(58) Field of Classification Search ..... 81/57.3, 81/57.31, 58.1
See application file for complete search history.

(56) References Cited

U.S. PATENT DOCUMENTS 2,520,443 A * 8/1950 Seaquist ..... 475/3
2,641,136 A * 6/1953 Marsden, Jr. et al. ..... 74/143
3,983,759 A * 10/1976 Linden ..... 74/88
4,357,844 A * 11/1982 Welbon ..... 81/57.39
4,366,731 A * 1/1983 Vallevand ..... 81/57.3
4,802,387 A * 2/1989 Williams, III ..... 74/810.1
4,970,915 A * 11/1990 Williams, III ..... 74/810.1
5,009,132 A * 4/1991 Gilberto ..... 81/57.3
5,105,688 A * 4/1992 Williams, III ..... 74/810.1
5,931,062 A * 8/1999 Marcovici ..... 81/57.31
6,681,660 B2 * 1/2004 Foard ..... 81/57.31

* cited by examiner

*Primary Examiner*—David B. Thomas
(74) *Attorney, Agent, or Firm*—Renner, Kenner, Greive, Bobak, Taylor & Weber

(57) ABSTRACT

Ratchet wrenches are provided that allow for drive on both the forward and return strokes of the ratchet handle. A combination ring gear, sun gear and planetary gear system is used in combination with a drive pawl arrangement to achieve power drive in both directions of operation, regardless of whether a tightening or loosening operation is desired. Accelerated speed of operation is attained upon the return stroke as a function of gear sizing. In other embodiments, the planetary gear system is replaced with an intermediate gear assembly external to any interengaging both a drive and driven gear. In other embodiments, the planetary gear system is replaced with an intermediate gear assembly external to and interengaging both a drive and driven gear.

20 Claims, 6 Drawing Sheets

RATCHET WRENCH HAVING CONSTANT DRIVE

TECHNICAL FIELD

The invention herein resides in the art of hand tools and, more particularly, to ratchet type wrenches, such as those commonly used as socket wrenches or the like. More particularly, the invention relates to a ratchet wrench having no lost motion, but which provides constant drive to the output or socket upon rotational movement of the handle in either direction, thus eliminating lost motion previously associated with such wrenches.

BACKGROUND ART

Ratchet type wrenches are commonly known and widely used. Such wrenches allow for the application of force or torque to a nut or bolt head without the need for the removal and replacement of the wrench upon the nut or bolt head at the end of each force applying movement. Accordingly, the speed with which a nut or bolt may be applied or removed is hastened with these types of wrenches. While these wrenches are typically used in association with sockets configured for particular nut or bolt head sizes, they are also used with individual wrenches configured for one specific nut or bolt head size. The invention herein contemplates use with both.

While ratchet type wrenches do allow for a significant acceleration of the work effort, common wrenches of this type have an associated lost motion. One direction of rotational movement of the wrench applies force or torque, while the return rotational movement is lost motion, in which no torque or force is applied. Accordingly, upon the return stroke, there is no movement of the nut or bolt. Such movement is only achieved during the power stroke that imparts torque to the work piece. The return stroke, though equal in rotational distance, is generally wasted motion.

It is also known that ratchet wrenches of the type under consideration are particularly problematic in tight quarters where the amount of available rotational movement is restricted. In such situations, with the return stroke being wasted motion, a significant amount of movement is necessary in order to effect the desired tightening or loosening of the nut or bolt.

There remains a need in the art for a ratchet type wrench that eliminates lost motion, and that effects a power drive, whether tightening or loosening, in both directions of operation, with the directional movement of the socket output shaft or wrench head being selectable by means of a pawl or the like.

DISCLOSURE OF THE INVENTION

In light of the foregoing, it is a first aspect of the invention to provide a ratchet wrench in which there is no lost motion.

Another aspect of the invention is the provision of a ratchet wrench that has accelerated operative motion on the return stroke.

Another aspect of the invention is the provision of a ratchet wrench that may selectively allow the implementation of operation on the return stroke.

Yet another aspect of the invention is the provision of a ratchet wrench that has enhanced and accelerated operative motion on the return stroke.

Still a further aspect of the invention is the provision of a ratchet wrench in which there is no lost motion, but which may be housed as a conventional ratchet wrench in an envelope as is commonly associated with such wrenches.

Still a further aspect of the invention is the provision of a ratchet wrench that is reliable and durable in operation, and given to construction with state of the art components.

The foregoing and other aspect of the invention that will become apparent as the detailed description proceeds are achieved by a ratchet wrench, comprising: a handle having a first gripping end and a second operational end; a shaft having a drive head at an end thereof maintained at said second operational end; a first ring gear in operative engagement with said shaft, driving said shaft in a first rotational direction in response to rotational movement of said handle about said shaft in a second rotational direction; and a second ring gear, planetary gear and sun gear in operative engagement with each other and with said shaft, driving said shaft in said first rotational direction in response to movement of said handle about said shaft in a rotational direction opposite that of said second rotational direction.

Other aspects of the invention are attained by a ratchet wrench, comprising: a handle having a first gripping end and a second operational end; a shaft having a drive head at an end thereof maintained at said second operational end; a first ring gear formed within a cavity in said second operational end; a second ring gear having a driven gear attached thereto and received by said cavity; a hand knob assembly having a drive gear formed therein received by said second operational end; an intermediate gear interposed between said drive gear and said driven gear; and first and second pawls received by said shaft, said first pawl in operative engagement with said first ring gear and said second pawl in operative engagement with said second ring gear.

DESCRIPTION OF DRAWINGS

For a complete understanding of the aspects and techniques of the invention, reference should be made to the following detailed description and accompanying drawings wherein.

BEST MODE FOR CARRYING OUT THE INVENTION

Figure 1:
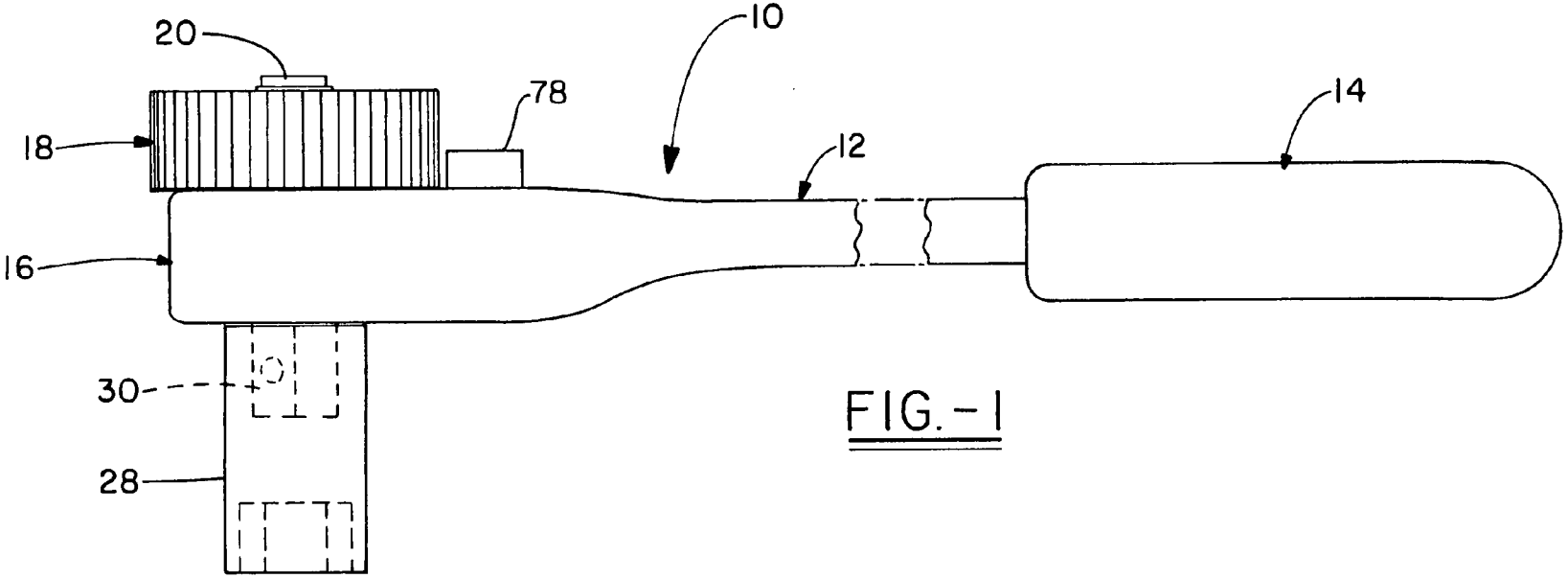
FIG. 1 is a side elevational view of a first embodiment of the ratchet wrench of the invention.
Figure 2:
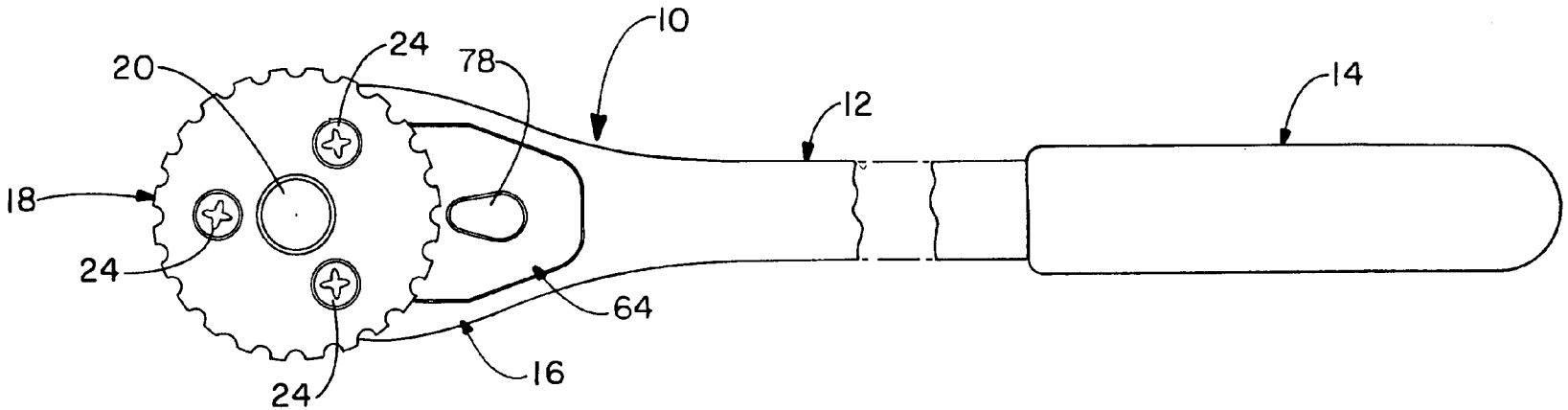
FIG. 2 is a top plan view of the wrench of FIG. 1.
Figure 3:
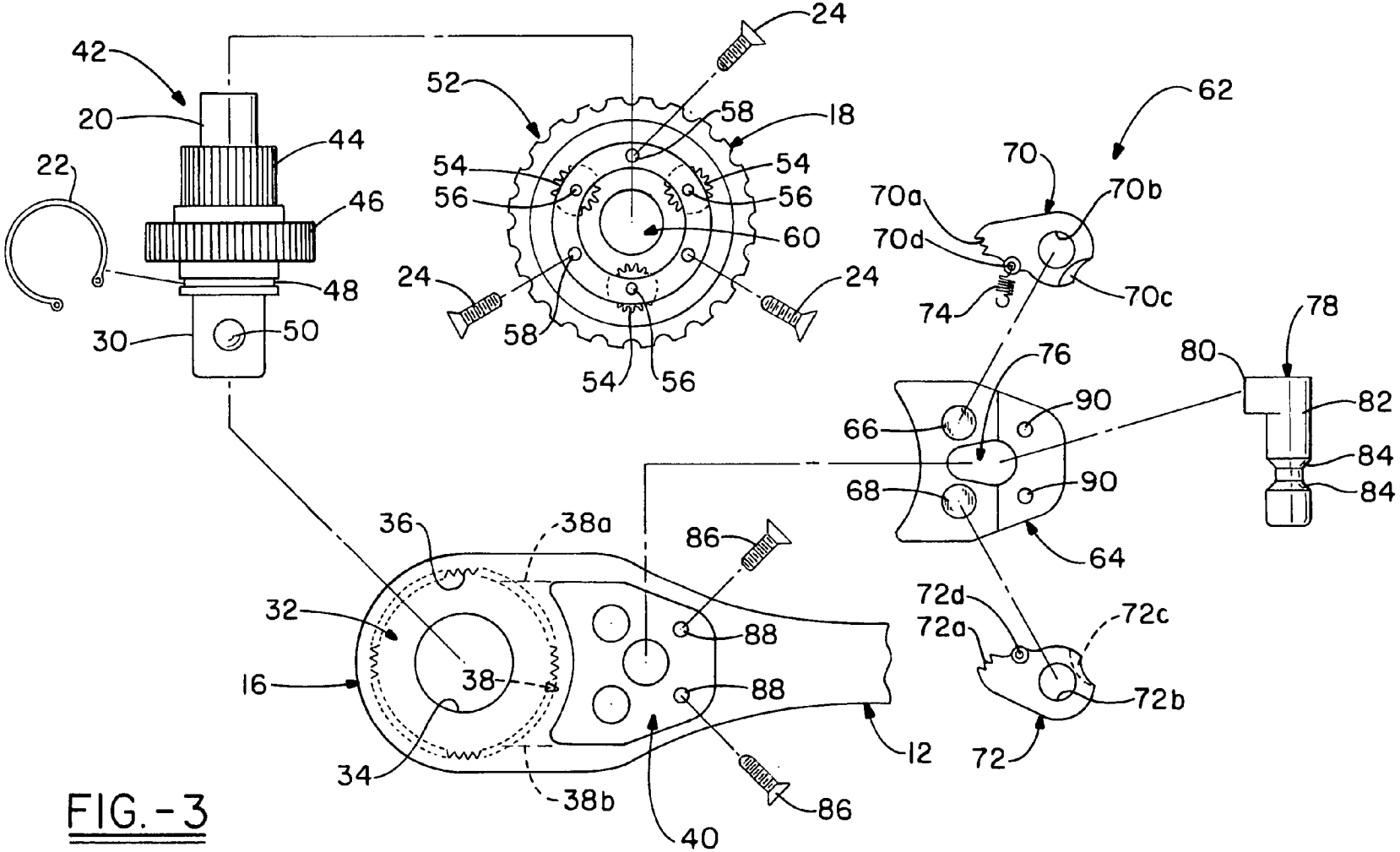
FIG. 3 is an assembly diagram of the wrench of the first embodiment of the invention as depicted in FIGS. 1 and 2.

Referring now to the drawings and more particularly FIGS. 1–3, an appreciation can be obtained of the concept of the invention, and particularly with regard to the first embodiment thereof in the form of a ratchet socket wrench 10. It will be appreciated, as presented above, that the concept of the invention is extendable beyond a socket wrench, but the same is presented here for purposes of discussion. The ratchet wrench 10 includes an elongated handle 12 having an elongated hand grip 14 at one end thereof and an operational head 16 at the other. A hand knob 18, preferably knurled about the circumference thereof, is provided at the operational head 16. A center shaft 20 extends through the operational head 16 and the hand knob 18, as shown. A keeper ring 22 retains the center shaft 20 in place, in standard fashion.

As best shown in FIGS. 2 and 3, screws 24 or other securing devices are employed to secure hand knob 18 to a planetary gear housing, as will become apparent later as discussed herein. A pawl actuator pushbutton 26 is provided to select the operative rotational direction of the socket 28 attached to an appropriate drive head 30.

As presented in FIG. 3, the operational head 16 is provided with a cylindrical cavity or partial depth bore 32 on the bottom side thereof. An aperture or through bore 34 is coaxial with the cavity 32 and extends from the bottom surface of the cavity through the operational head 16. An internal ring gear 36 is formed about the inner circumferential surface of cavity 32, extending downwardly a sufficient distance for the purpose that will become apparent herein. In any event, the internal ring gear 36 terminates short of an undercut or through passage 38, extending between phantom lines 38*a* and 38*b* that extends to and interconnects with a housed-out receptacle 40 that is adapted to receive the pawl assembly to be discussed later herein.

A central drive assembly 42, consisting of the center shaft 20 and drive head 30, is configured with a sun gear 44 and an external ring gear 46 fixedly mounted thereto. As will become apparent later herein, the external ring gear 46 is adapted for engagement with the pawl assembly. A groove 48 is provided about a bottom end of the center shaft 20 for receipt of a keeper ring or the like for securing the assembly 42 to the operational head 16 after the drive head 30 has passed through the aperture or through bore 34. In somewhat standard fashion, a spring loaded ball 50 is provided for engaging the socket 28 to retain it upon the drive head 30.

A planetary gear housing 52 is machined to receive planetary gears 54, equally spaced thereabout. The planetary gears 54 are held within the housing 52 by pins 56, about which they may rotate. Threaded bores 58 are provided within the planetary gear housing 52 to receive the screws 24 that serve to secure the hand knob 18 to the planetary gear housing 52. A bore 60 passes through the base of the planetary gear housing 52, providing an exit for the center shaft 20 and the keeper ring 22.

As further shown in FIG. 3, a pawl assembly 62 is adapted to be received within the housed-out receptacle 40. The assembly 62 includes a housing 64 configured to nest within the cavity 40. A pair of posts 66, 68 extends from the housing 64 and are adapted to receive respective pawls 70, 72. Each of the pawls is characterized by teeth 70*a*, 72*a*, a bore 70*b*, 72*b* for respective posts 66, 68, cam surfaces 70*c*, 72*c*, and apertures 70*d*, 72*d* for receiving a spring 74, tending to urge the pawls 70, 72 inwardly toward each other when mounted upon the posts 66, 68. With the pawls 70, 72 mounted upon posts 66, 68, the housing 64 can be placed within the cavity 40, with the ends of the pawls, 70, 72 having teeth 70*a*, 72*a* extending through the undercut or through passage 38 and into the cylindrical cavity 32.

A bore 76 passes through the pawl housing 64 to receive a pawl selector actuator pin 78, characterized by a head 80, for thumb actuation and a body 82. Cam surfaces 84 characterize the body 82 to selectively engage cam surfaces 70*c* and 72*c* to mutually exclusively engage and disengage the pawls 70, 72 with the external ring gear 46, when assembled.

As shown, screws 86 are provided to pass through the through bores 88 at the bottom of the cavity 40 and into threaded bores 90 within the pawl housing 64 to retain the housing in the cavity 40.

As should be apparent from FIG. 3, the structure of the ratchet wrench 10 is achieved in assembly by placing the central drive assembly 42 into the cylindrical cavity 32, with the drive head 30 and end of shaft 20 passing through the aperture 34. The hand knob 18, secured to the planetary gear housing 52, is then placed over the exposed end of the center shaft 20, such that the planetary gears 54 engage the sun gear 44. A keeper ring 22 secures the hand grip assembly 18 in place. The planetary gears 54 also engage the internal ring gear 36 about the inner circumference of the cavity 32. An appropriate keeper ring is secured in the groove 48 at the end of the center shaft 20 and above the drive head 30 to retain the assembly 42 on the opposite side of the operational head 16.

With the pawls 70, 72 mounted upon the posts 66, 68, pawl housing 64 is placed into the housed-out cavity 40, with the pawls 70, 72 having the teeth ends 70*a*, 72*a* extending through the undercut 38 and into engagement with the external ring gear 46. The pawl selector and actuator pin 78 is then placed into the through bore 76 and aligned bore 92 of the housed-out section 40. The housing 64 is then secured by appropriate screws 86 through the unthreaded bored 88 and into the threaded bores 90.

In use, an operator selects the mode of operation by the position of the depression of the pawl selector pin 78. Traditionally, a clockwise direction tightens the right handed thread and a counterclockwise direction untightens it. When the socket 28 is placed over a nut or bolt head, and with the hand knob 18 either not held or held in an unrestricted manner so that it is free to rotate, the ratchet wrench 10 operates as a standard ratchet, driving only in one direction, and freewheeling with lost motion in the return direction. In other words, the engaged pawl 70, 72 engages the ring gear 46 in the drive direction, and is freewheeling in the return direction. However, when the user applies restrictive gripping force to the hand knob 18, the planetary gear housing remains stationary such that rotation of the handle 12 forces rotation of the internal ring gear 36 to cause the planetary gears 54 to rotate, thus driving the engaged sun gear 44 and the attached center shaft 20 and drive head 30, thus causing the center shaft 20, drive head 30 and socket 28 to rotate in the same direction as on the power stroke. Accordingly, the socket 28 drives in the same direction on both the power and return strokes, provided that the hand knob 18 is secured and prevented from rotating in what would otherwise be the return stroke. The speed and torque of the rotation of the socket 28 on the return stroke is determined by the sizes of the gears 36, 54, 44, as would be appreciated by those skilled in the art.

It can thus be appreciated that with the embodiment of FIGS. 1–3, there is no lost motion on the return stroke of the ratchet wrench if the user simply grips and retains the hand knob 18, holding the planetary gear housing 52 stationary. If not held tightly, the housing simply rotates on the return stroke with the sun gear and attached shaft 20 remaining substantially stationary.

Figure 4:
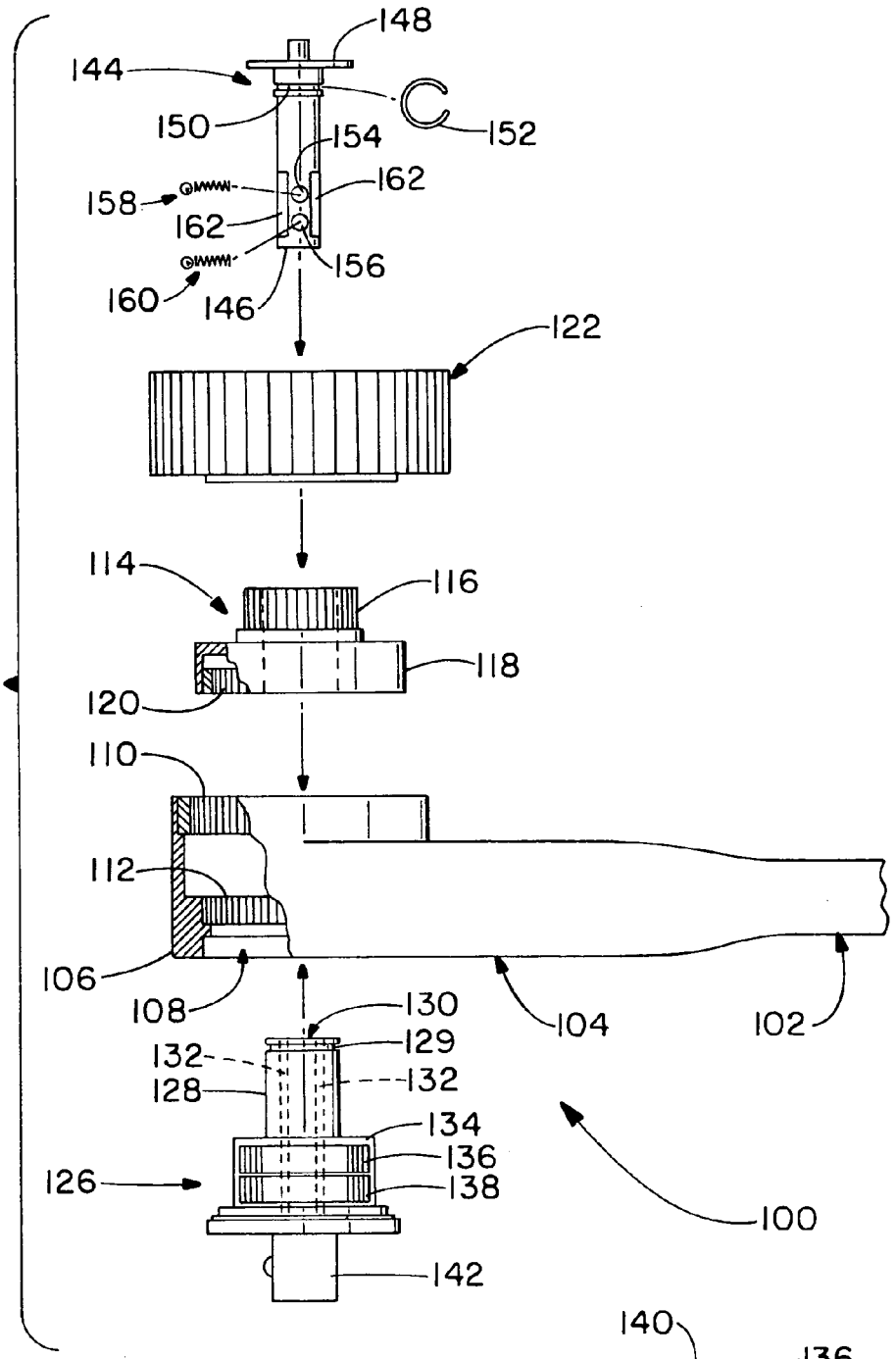
FIG. 4 is an assembly diagram of a second embodiment of the invention.
Figure 5:
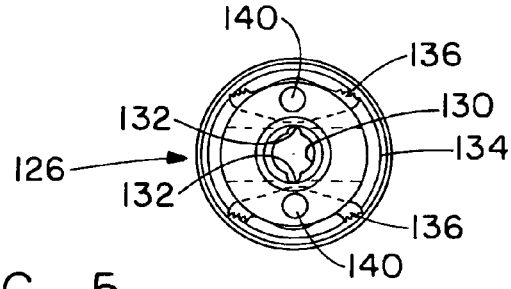
FIG. 5 is a top plan view of the pawl assembly of the embodiment of FIG. 4.

With reference now to FIGS. 4 and 5, an appreciation can be obtained with regard to a second embodiment of a ratchet wrench made in accordance with the invention, designated generally by the numeral 100. Again, the wrench 100 is provided with an elongated handle 102 having a handle grip or the like at an end thereof such as that associated with the embodiment 10. An operational head 104 is positioned at an opposite end of the wrench 100. At the operational head 104, a housing 106 is provided with a bore 108 therethrough. The bore 108 is characterized by a top ring gear 110 about the upper inner circumference thereof, and a bottom ring gear 112 about the lower inner circumference thereof. A gear assembly insert 114 is provided for receipt by the bore 108, and is characterized by an external sun gear 116 at a top portion thereof, resting atop a cup shaped bottom portion 118 having an internal ring gear 120 about the inner circumference thereof. As will become apparent herein, the ring gear 120 serves only as a ratchet stop and does not mesh gears.

A hand knob 122, similar to the knob 18 of the embodiment 10, is provided. The knob 122 has a planetary gear assembly 124 similar to the planetary gear assembly 52, 54, 56 of the embodiment 10, as shown in FIGS. 1–3. The planetary gears 54 are adapted for engagement with the sun gear 116, as will become apparent below.

A drive and pawl assembly 126 is provided for receipt at the bottom of the bore 108. The assembly 126 includes a center shaft 128 having a groove 129 at the top thereof for receipt of a keeper ring for maintaining the shaft within a recess of the knob 122. The center shaft 128 includes a bore 130 having side grooves 132 extending axially along the sides thereof for receipt of the pawl actuator to be described hereafter. The assembly 126 further includes a hub 134 circumferentially about the center shaft 128. A pair of upper pawls 136 and a pair of lower pawls 138 are mounted upon pins 140 extending from the hub 134, each pawl having teeth at opposite ends thereof. The pawls have cam surfaces at center portions thereof, which allow a pawl actuator to selectively engage the pawls with respective ones of the ring gears 112, 120. Finally, a drive head 142 extends downwardly from the center shaft 128 for purposes of receiving a socket or the like.

As shown at the top of FIG. 4, a pawl actuator 144 is provided for receipt by the knob 122, gear assembly insert 114, and center bore 130 of the center shaft 128 for actuating engagement with the pawls 136, 138. The pawl actuator 144 comprises a pin 146 having a head 148 with a turn knob extending therefrom. A groove 150 is provided near the top of the pin 146 for receipt of an appropriate keeper ring 152, to secure the pawl actuator 144 in place.

The pin 146 is provided with an upper bore 154 and a lower bore 156 passing diametrically therethrough. The bores 154, 156 are respectively adapted to receive upper and lower pairs of balls and interposed spring assemblies 158, 160. The spring biased balls are the actuator means for the cam surfaces of the upper and lower pawls 136, 138. Side grooves 162 are provided within the pin 146 to provide clearance for the cam surfaces upon actuation.

As is apparent from FIGS. 4 and 5, the assembly of the ratchet wrench 100 is achieved by placing the gear assembly insert 114 into the bore 108 of the housing 106, such that the insert 114 rests upon an upper annular surface of the internal ring gear 120. The drive and pawl assembly 126 may then be brought upwardly into the bore 108, such that the upper pair of pawls 136 is in operative engagement with the ring gear or pawl stop 120, and the lower pair of pawls 138 is in operative engagement with the ring gear 112. The knob 122 is then brought down over the top of the housing 106, such that the planetary gear assembly 124 engages the sun gear 116 and the top ring gear 110. An appropriate keeper ring may then be inserted in the groove 110 at the top of the shaft 128 to hold the assembly together.

Next, the pawl actuator assembly 144 is slid downwardly through the bore 130 of the center shaft 128, with the grooves 132 of the bore 130 accommodating such movement by receipt of the balls of the ball and spring assemblies 158, 160. When bottomed in place, a keeper ring 152 secures the assembly 144 in place.

In use, the operator sets a direction of operation by means of the pawl actuator 144, engaging the pawls 136 with the ring gear 120 and the pawls 138 with the right gear 112 in a selected position of operation. Movement of the pawl actuator 144 selects an opposite direction. In use, the direction of drive is selected by engagement of the pair of pawls 138 with the ring gear 112, which is integral with the housing 106. Accordingly, there is a direct drive of the drive head 142 by this interconnection. On the return stroke, with the operator holding the knob 122 and, accordingly, the housing of the planetary gear assembly 124, the ring gear 110 drives the planetary gears 124 which, in turn, drive the sun gear 116 which, in the embodiment shown, is integral with the ring gear 120. The ring gear 120 is, in turn, engaged with the upper pawls 136 to drive the drive head 142 in the same direction as on the drive stroke, but at an increased speed and reduced torque dependent upon the gear sizes.

Figure 6:
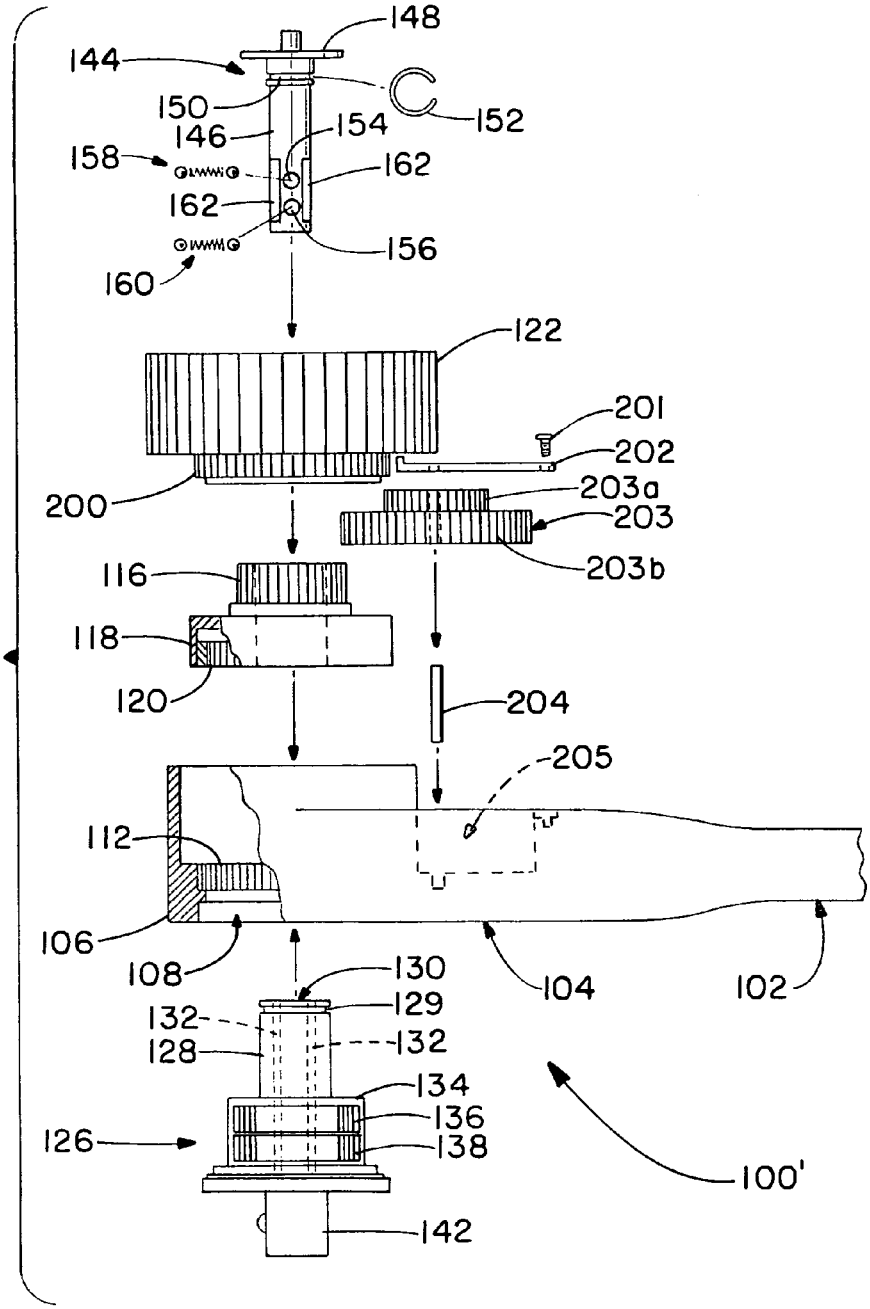
FIG. 6 is an assembly diagram of a third embodiment of the invention.
Figure 7:
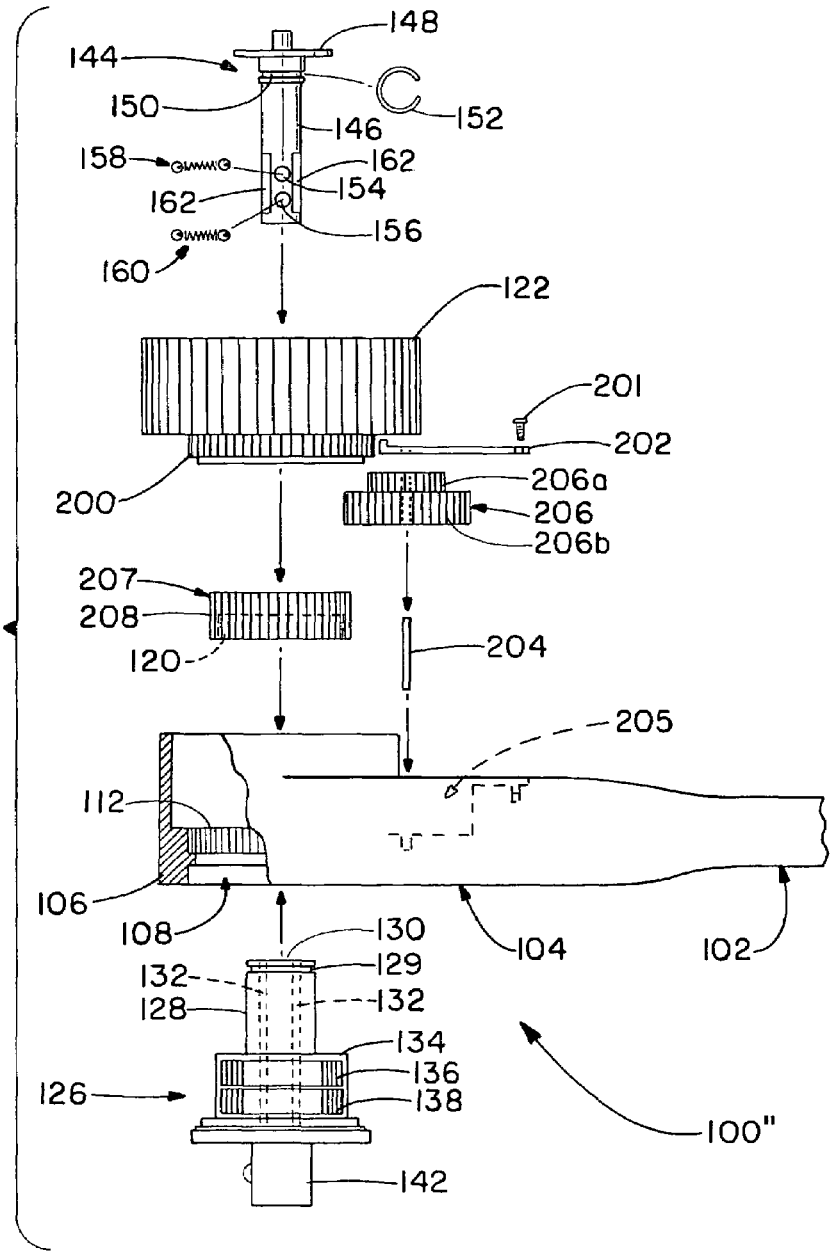
FIG. 7 is an assembly diagram of a fourth embodiment of the invention.
Figure 8:
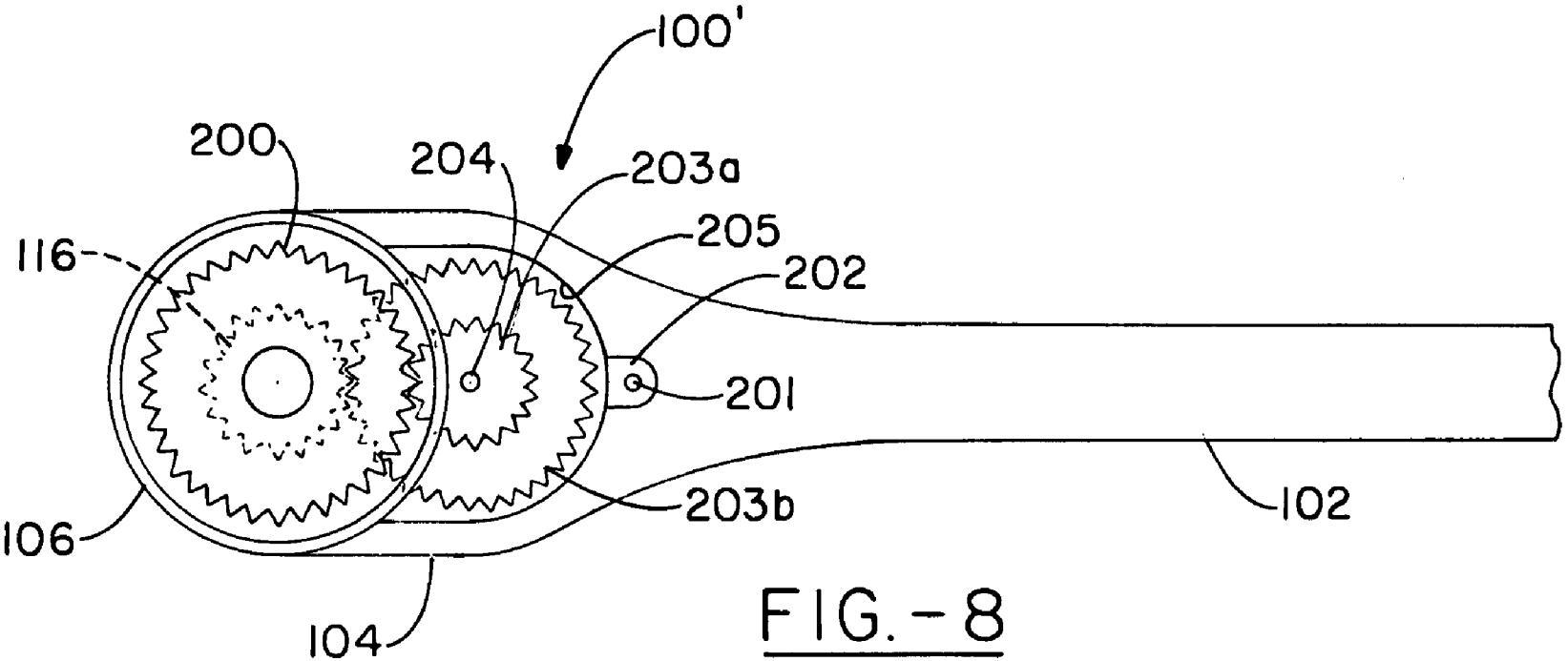
FIG. 8 is an illustrative top plan view of the third embodiment of the invention.

With reference now to FIGS. 6–8, an appreciation may be obtained of a ratchet wrench made in accordance with the invention, and comprising a slight variation on the theme of the wrench 100 presented in FIGS. 4 and 5. With reference first to FIG. 6, it can be seen that a third embodiment of a ratchet wrench made in accordance with the invention is designated generally by the numeral 100'. The ratchet wrench 100' is similar to the ratchet wrench 100 and, accordingly, where the same elements are used, they are identified by the same numbers. In that regard, and of particular importance, are the pawl actuator 144, drive and pawl assembly 126, handle 102, bore 108 and ring gear 112. The planetary housing 52 and planetary gears 54 of the knob or hand grip 122 of the embodiment 100 are replaced with a ring gear or drive gear 200 and an intermediate gear assembly 203 in the embodiment 100'. The ring or drive gear 200 is fixed to, and may be a part of, the knob 122. The intermediate gear assembly 203 comprises external ring gears **203*a* and 203*b*, which would typically comprise an integral piece received upon and rotatable about a pin or axle 204 within a cavity 205 of the operational head 104 at the end of the elongated handle 102. The ring gear assembly 203 is retained within the cavity 105 by means of a cover 202 secured by a screw or other fastening device 201**.

As will be readily appreciated by those skilled in the art, the ring gear or drive gear 200 is adapted to interengage with ring gear **203*a* of the intermediate gear assembly 203. In similar fashion, the ring gear 203*b* of the intermediate gear assembly 203 is adapted to interengage with the driven gear 116, which is the same as the sun gear of the ratchet wrench 100 depicted in FIG. 4**.

In use, the pawl actuator 144 is employed by the operator to select the desired direction of operation and, consistent with the operation of the ratchet wrench 100, the pawl gears 136, 138 are appropriately engaged with the internal ring gear 120 and bottom ring gear 112, respectively. The operator then grips the knob 122 to restrict its movement such that movement of the handle 102 causes rotation of the drive head 142 as a consequence of the driving interengagement between the pawl 138 and bottom ring gear 112. During this operation, the pawl 136 overrides the internal ring gear 120 that is driven through the driven gear 116 by the external ring gear **203*b* of the intermediate gear assembly 203. The intermediate gear assembly is driven by the ring gear 203*a* in its engagement with the ring or drive gear 200, which is held stationary by the user's grip on the knob 122. When the direction of operation of the handle 102 is reversed, the intermediate gear assembly 203, interposed between the drive gear 200 and driven gear 116, causes driving of the drive head 142 through the engagement of the pawl assembly 136 with the internal ring gear or pawl stop 120. The speedup realized by implementation of the ratchet wrench 110' in what would otherwise be the return movement of the handle 102 is determined by the gear ratio achieved between the drive gear 200 and the driven gear 116 through the intermediate gear assembly 203**. Where the gear ratio is greater than 2 to 1, a speedup of operation is realized.

With reference now to FIG. 7, an appreciation can be had of yet another embodiment of a ratchet wrench according to the invention. Here, the wrench 100" is substantially similar to the wrench 100' of FIG. 6, but for the use of a driven gear 207 to replace the driven gear 116 and internal ring gear 120 of the embodiment of 100'. Here, the driven gear assembly 207 includes external gear teeth 208, while retaining the internal ring gear or pawl stops 120 as discussed previously herein. To accommodate the driven gear assembly 207, the intermediate gear 203 is replaced with an intermediate gear 206, specifically configured such that the gear 206*a* meshes with the drive gear 200 and the gear 206*b* meshes with the driven gear 207. Again, as with the embodiment 100' of FIG. 6, the effective gear ratio between the drive gear 200 and driven gear 207 determines the speed-up effected by the wrench 100'.

It will be appreciated that both embodiments 100' and 100" move the axle or pin 204 with the handle 102, losing some of the speed-up of operation on the normal lost motion movement of the handle. In these embodiments, it has been found that the gear ratio between the gears 200 and 116 or 200 and 207 and must be greater than 1 to 1. At a gear ratio of 2 to 1, equal speed is achieve in both directions of operation. When the gear ratio exceeds 2 to 1, a speed-up is realized.

With reference now to FIG. 8, a top plan illustrative view of the ratchet wrench 100' may be attained. The various interrelationships between the gear 200 and 203*a* and the gear 116 and 203*b* are shown, as well as the implementation of the cover 202, secured by a screw 201 to the operational head 104.

Thus it can be seen that the various aspects of the invention have been satisfied by the structure presented above. While in accordance with the patent statutes only the best mode and preferred embodiments of the invention have been presented and described in detail, the invention is not limited thereto or thereby. Accordingly, for an appreciation of the true scope and breadth of the invention, reference should be made to the following claims.

What is claimed is:

1. A ratchet wrench, comprising:

a handle having a first gripping end and a second operational end;

a shaft having a drive head at an end thereof maintained at said second operational end;

a first ring gear in operative engagement with said shaft, driving said shaft in a first rotational direction in response to rotational movement of said handle about said shaft in a second rotational direction; and a second ring gear, planetary gear and sun gear in operative engagement with each other and with said shaft, driving said shaft in said first rotational direction in response to movement of said handle about said shaft in a rotational direction opposite that of said second rotational direction.

2. The ratchet wrench according to claim 1, wherein said planetary gear is interposed between said second ring gear and said sun gear.

3. The ratchet wrench according to claim 2, further comprising a pawl assembly in selective operative engagement with said shaft.

4. The ratchet wrench according to claim 3, wherein said planetary gear is maintained within a planetary gear housing that is restrictably rotatable about said shaft.

5. The ratchet wrench according to claim 4, wherein said planetary gear housing is connected to a hand knob configured to be engaged by a user to selectively restrict rotation of said planetary gear housing about said shaft.

6. The ratchet wrench according to claim 5, wherein said first ring gear is fixedly secured to said shaft.

7. The ratchet wrench according to claim 6, wherein said sun gear is fixedly secured to said shaft.

8. The ratchet wrench according to claim 7, wherein said pawl assembly is selectably directionally engageable with said first ring gear.

9. The ratchet wrench according to claim 8, wherein said pawl assembly engages and drives said first ring gear in said first rotational direction in response to said rotational movement of said handle about said shaft in said second rotational direction.

10. The ratchet wrench according to claim 9, wherein said second ring gear is integral with said second operational end of said handle.

11. The ratchet wrench according to claim 5, wherein said first ring gear comprises a first gear portion fixed to said operational end of said handle and a second gear portion fixed to said sun gear.

12. The ratchet wrench according to claim 11, wherein said pawl assembly comprises first and second pawl portions in selective engagement with said first and second gear portions.

13. The ratchet wrench according to claim 12, wherein said first and second pawl portions are in rotationally directionally opposite engagement with respective ones of said first and second gear portions.

14. The ratchet wrench according to claim 13, wherein said pawl assembly is connected to said shaft.

15. The ratchet wrench according to claim 14, wherein engagement of said first pawl portion with said first gear portion effects said driving of said shaft in said first rotational direction in response to said rotational movement of said handle about said shaft in said second rotational direction, and engagement of said second pawl portion with said second gear effects said driving of said shaft in said rotational direction opposite that of said second rotational direction.

16. The ratchet wrench according to claim 12, wherein said first and second gear portions are axially aligned and of the same diameter.

17. The ratchet wrench according to claim 16, wherein said second gear portion is coaxial with said sun gear and formed about an inner circumference of a cup upon which said sun gear is attached.

18. A ratchet wrench comprising:

a handle having a first gripping end and a second operational end;

a shaft having a drive head at an end thereof maintained at said second operational end;

a first ring gear formed within a cavity in said second operational end;

a second ring gear having a driven gear attached thereto and received by said cavity;

a hand knob assembly having a drive gear formed therein received by said second operational end;

an intermediate gear interposed between said drive gear and said driven gear; and first and second pawls received by said shaft, said first pawl in operative engagement with said first ring gear and said second pawl in operative engagement with said second ring gear.

19. The ratchet wrench according to claim 18, wherein said intermediate gear has a first gear portion meshing with said drive gear, and a second gear portion meshing with said driven gear.

20. The ratchet wrench according to claim 19, wherein said driven gear and said second ring gear are concentric.

* * * * *